US006419448B1

(12) United States Patent
Owczarek

(10) Patent No.: US 6,419,448 B1
(45) Date of Patent: Jul. 16, 2002

(54) FLOW BY-PASS SYSTEM FOR USE IN STEAM TURBINE EXHAUST HOODS

(76) Inventor: Jerzy A. Owczarek, 2345 Overlook Dr., Bethlehem, PA (US) 18017-3738

( * ) Notice: Subject to any disclaimer, the term of this patent is extended or adjusted under 35 U.S.C. 154(b) by 0 days.

(21) Appl. No.: 09/531,541

(22) Filed: Mar. 20, 2000

(51) Int. Cl.[7] ..... F01D 25/30

(52) U.S. Cl. ..... 415/207; 415/211.2; 415/220; 415/226; 415/914; 60/692; 60/694; 60/697

(58) Field of Search ..... 415/1, 914, 211.2, 415/220, 213.1, 214.1, 207, 176–178, 224.5, 225, 226; 60/690, 692, 694, 697

(56) References Cited

U.S. PATENT DOCUMENTS

| | | | | | |
|---|---|---|---|---|---|
| 1,269,998 | A | * | 6/1918 | Baumann | 60/697 |
| 3,149,470 | A | * | 9/1964 | Herzog | 60/697 |
| 3,630,635 | A | * | 12/1971 | Fatum | 415/213.1 |
| 3,791,759 | A | * | 2/1974 | Tetrault | 415/144 |
| 4,013,378 | A | * | 3/1977 | Herzog | 415/220 |
| 4,214,452 | A | * | 7/1980 | Riollet et al. | 60/697 |
| 4,326,832 | A | * | 4/1982 | Ikeda et al. | 415/220 |
| 5,174,120 | A | * | 12/1992 | Silvestri, Jr. | 60/692 |
| 5,257,906 | A | * | 11/1993 | Gray et al. | 415/226 |
| 6,261,055 | B1 | * | 7/2001 | Owczarek | 415/211.2 |

FOREIGN PATENT DOCUMENTS

| | | | | |
|---|---|---|---|---|
| SU | 1724903 A | * | 4/1992 | 415/226 |

* cited by examiner

*Primary Examiner*—Christopher Verdier
(74) *Attorney, Agent, or Firm*—Charles A. Wilkinson

(57) ABSTRACT

A flow by-pass system is provided in a downward-discharging exhaust hood of a steam turbine to by-pass a small percentage of the total steam flow from the top portion of the exhaust hood to the vicinity of the condenser and in that way relieve excess pressure in the top portion incident to the more convoluted path of the main portion of steam passing from the top to the bottom and to decrease energy loss caused by friction and thus to improve turbine efficiency. The flow by-pass system includes by-pass conduits within the front portion of the exhaust hood extending from the top portion to the vicinity of the condenser. Such conduits are formed by covering over the corners between the outer and end walls of the exhaust hood and between the exhaust hood end wall and the bearing cone outside surface with by-pass walls to form flow passages in the corners behind the by-pass walls through which exhaust steam may pass from the region of higher pressure in the top portion of the exhaust hood to the region of lower pressure in vicinity of the condenser. Inlets and outlets are provided in the by-pass walls for entrance and exit of the turbine exhaust steam to the by-pass conduits.

27 Claims, 5 Drawing Sheets

VIEW IN DIRECTION B-B

VIEW IN DIRECTION F - F

FLOW BY-PASS SYSTEM FOR USE IN STEAM TURBINE EXHAUST HOODS

BACKGROUND OF INVENTION

1. Field of Invention

This invention relates to steam turbines in general and more particularly to downwardly discharging exhaust hoods for such turbines and more specifically to effecting a decrease of pressure and energy loss in the top portion of such exhaust hoods.

2. Discussion of Prior Art

The steam leaving the last row of blades of steam turbines used in power generation generally flows through an annular passage between the turbine enclosure or casing and the bearing cone into a collector called an "exhaust hood", from which it discharges into a condenser. The most prevalent type of the exhaust hood is one of "downward-discharging" design in which the condenser is located below the exhaust hood. This arrangement saves floor space in a power station, but has disadvantages so far as efficient flow in the exhaust hood itself is concerned.

At the top of a downward-discharging exhaust hood, steam leaving the last row of blades of a turbine and after passing through the usual annular flow diffuser follows a tortuous path on its way to the condenser. It is forced by the end and outer walls of the exhaust hood to turn back, that is, to turn in a direction which is essentially opposite to that in which it leaves the turbine. Subsequently, it is further turned downwardly and directed around the turbine casing so that it exits the exhaust hood in a predominantly downward direction as it enters the condenser. A considerable amount of the steam passing through the upper portion of a downwardly discharging exhaust hood therefore changes direction from the time it leaves the annular flow diffuser to the time it reaches the condenser by as much as 270 degrees or more. In contrast, in the bottom portion of the exhaust hood steam exhausting from the annular flow diffuser changes its flow direction only from mainly horizontal to vertically downward or essentially 90 degrees. Consequently, while at the top of the exhaust hood most of the flowing steam changes its direction by approximately 270 degrees before it becomes oriented toward the condenser, followed by additional changes in flow direction caused by the necessity to flow around the turbine casing before it actually enters the condenser, its direction is changed by only about 90 degrees in the bottom of the exhaust hood before entering the condenser. Every turn of a stream of steam, or change of its flow direction, entails a change of its linear momentum, which requires forces to be exerted by the containing walls on the flowing steam causing an increase of steam pressure. As a result, the pressure in the top or upper portion of a downward discharging exhaust hood is appreciably higher than in the bottom portion. This pressure rise in the top portion of the exhaust hood increases the back pressure of the steam turbine and thus decreases the energy available to the turbine to generate power and consequently lowers such turbine's overall efficiency.

It should also be noted that the turn, or change of direction, of the steam between the end wall and the outer wall of an exhaust hood takes place mainly in the corner region which exists between these two walls. In that corner region the flow separates from the end wall and forms what is known as a "separated-flow region" in which significant kinetic energy loss occurs as a result of friction. A tightly spiraling separated flow, or vortex, tends to form, which vortex extends in the outer corner region from the top and on both sides of the exhaust hood toward the condenser flange in the general shape of a horseshoe. In addition, the steam flowing initially along the bearing cone separates in the vicinity of the corner which usually exists between the bearing cone outside surface and the exhaust hood end wall forming another "separated-flow region" filled by another vortex of steam. Energy loss occurs in both of these "separated-flow regions" as a result of friction of the vortex steam with the walls of the exhaust hood as well as with the passing steam.

Attempts have been made to eliminate the "separated-flow regions" in the corners of exhaust hoods by placing curved walls or plates over such corners to more smoothly direct the steam flow past them and thus to improve turbine efficiency.

The flow by-pass system of this invention not only eliminates the "separated-flow regions" and associated energy losses, but, by allowing a significant fraction of the steam which enters the top quadrant of the exhaust hood to by-pass the top and back portions of the exhaust hood there is a resultant decrease of the pressure rise there as a result of decreasing the amount of the turning flow stream as well as its velocity, further significantly improving turbine efficiency. As was stated earlier, lowering of pressure at the exit of a turbine results in an increase of the energy available to the turbine. Lowering of the flow velocity results in lowering of friction losses which are proportional to the square of the flow velocity. There has been a need, therefore, not only for elimination of the "separated-flow regions" in the corners adjacent to the exhaust hood end wall but also a need to lower the steam pressure and the flow velocity in the upper or top portion of the exhaust hood.

Attempts have been made in the past to decrease energy losses in steam turbine exhaust hoods. For example, U.S. Pat. No. 1,269,998 issued Jun. 18, 1918 to K. Baumann, assigned to Westinghouse, U.S.A., entitled "Steam Turbine" discloses a steam turbine having a downwardly curved exhaust at the end of the turbine. In order to better control the flow of steam to the condenser and avoid backup of steam due to vortices and the like, the steam flow is divided up into at least upper and lower streams by partitions or baffle plates. This avoids, it is said, the steam from various portions of the turbine and particularly the top portion and bottom portion from meeting each other at different angles, or from different directions, causing eddies and the like which would interfere with rapid exhaust of steam from the turbine. The uniformity of the travel passage of the steam from the turbine when it enters the condenser or exhaust is thus enhanced. This disclosure does not show an exhaust hood installation directly over a condenser, but is an early example of the widespread continuing practice of using guide vanes to aid in directing turbine exhaust flow.

U.S. Pat. No. 3,791,759 issued Feb. 12, 1974 to J. A. Tetrault, assignor to the U.S. Government, entitled "Turbine Pressure Attenuation Plenum Chambers" discloses in a gas turbine the use of pressure attenuation chambers adjacent the exit from the turbine blades which are followed by stationary vanes. Excess gas pressure causes leakage of flow through orifices into such chambers when pressure rises excessively. The reference broadly illustrates the temporary withdrawal of gas from the exhaust to equalize pressure with the intent of trying to reduce circumferential pressure distortion in a turbine which is not provided with a downwardly discharging exhaust hood.

U.S. Pat. No. 3,149,470 issued Sep. 22, 1964 to J. Herzog, assignor to General Electric Company entitled "Low Pressure Turbine Exhaust Hood" discloses a hollow, substantially frusto-conical, flow dividing member disposed inside an exhaust hood co-axial with the turbine rotor which divides the flow from the turbine casing outlet into radially inner and radially outer annular portions which are further sub-divided by additional substantially radial flow guiding walls which form a number of parallel passages leading toward the exhaust hood outlet. One of the two flow annuli is formed between the circular opening of the flow-dividing member and the outer flow guide extending from turbine casing. The other annulus is formed between the circular opening of the flow dividing member and the bearing cone. This prior invention has little if any relation to the present invention in which only a small fraction of the total turbine exhaust flow is by-passed from the top quadrant of the exhaust hood to the bottom portion. There is no physical similarity between these two inventions. In the present invention the space within the exhaust hood remains essentially unchanged by the introduction of the flow by-pass system of the invention. In the Herzog invention the turbine exhaust flow annulus is sub-divided, in proximity of the turbine last stage blades, into two portions.

A variant of U.S. Pat. No. 3,149,470 by J. Herzog is illustrated in FIG. 4-42 on page 106 of K. Cotton's book: Evaluating and Improving Steam Turbine Performance" published by Cotton Fact Inc., LSBN#: 0-963339955-0-2, Library of Congress Number 93-0910089 in 1993. It retains the flow-dividing member of the original Herzog design but only in the bottom portion of the exhaust hood. In this variant the exhaust flow sub-division takes place wholly in the bottom portion of the exhaust hood which location is opposite to the location of the inlet vents of the flow by-pass system of the present invention which are in the top portion of the exhaust hood only.

U.S. Pat. No. 4,013,378 issued on Mar. 22, 1977 to J. Herzog assignor to General Electric Company entitled "Axial Flow Turbine Exhaust Hood" discloses the use of a plurality of curved guide vanes of varying curvatures spaced about a circumferential guide ring in the exhaust from a turbine to direct exhaust steam from a generally axial to radial direction, and secondary guide vanes directing steam flow toward the discharge opening of the exhaust hood toward the condenser. There is no by-passing or draining off of some of the steam from the upper or top portion of the exhaust hood and directing it to the lower or bottom portion to decrease the pressure and the flow velocity in the top portion of the exhaust hood.

U.S. Pat. No. 4,214,452 issued on Jul. 29,1980 to G. Riollet et al., assignors to Alsthom-Atlantique of Paris, France, entitled "Exhaust Device for a Condensable-Fluid Axial-Flow Turbine" discloses in an annular diffuser an extraction-type suction slot or slots through which a fraction of flowing fluid is removed at the outer flow guide so as to make the pressure gradient there either negative or zero. The removed fluid is directed to a lower portion of a two-zone condenser and the remainder to a higher-pressure portion of the two-zone condenser. The location of the removal of fluid at the outer flow guide of the annular exit flow diffuser in the vicinity of the turbine last stage blades distinguishes this invention from the present invention in which fluid is removed in the exhaust hood proper. In addition, the object of this invention is to prevent flow separation from the outer flow guide or "break down of the fluid flow" there and not to decrease the pressure and flow velocity in the top portion of the exhaust hood which is object of the present invention. Also, since in a Low-pressure (LP) condensing turbine the pressure at the location of the suction slot on the convex side of the diffuser is usually as low or even lower than the pressure in the condenser itself, the Riollet et al. invention can only be used in either a High-pressure (HP) section of the turbine or in the Intermediate-pressure (IP) section of a condensing turbine, or only with a specially-designed condenser having multiple zones.

U.S. Pat. No. 4,326,832 issued to T. Ikeda et al. On Apr. 27, 1982, entitled "Exhaust Outer Casing", assigned to Tokyo Shibaura Denki Kabushi Ki Kaisha of Kawasaki, Japan, discloses a side discharge steam exhaust including the use of a guide plate or vane that separates the top discharge steam from lower discharge steam in the exhaust hood and uses curved guide vanes in the hood. However, there is no siphoning off of a portion of the steam exhaust from the upper portion of the exhaust hood and transferring it to the lower portion of the hood.

U.S. Pat. No. 5,174,120 issued to G. J. Silvestri, Jr., assignor to Westinghouse, on Dec. 29, 1992, entitled "Turbine Exhaust Arrangement for Improved Efficiency" discloses a turbine arrangement in which a condenser on the bottom of such arrangement is divided by a plate in the center of the condenser which separates the inlet sections of the tubes of the condenser from the outlet sections of the tubes of the condenser creating a low pressure chamber and a higher pressure chamber, or section, forming thereby a zoned condenser. At the same time the exhaust hood above has partition plates dividing the steam exiting the turbine into left and right half portions. An increased efficiency is claimed. Although in the Silvestri arrangement the turbine exhaust is divided into separate zones, in the arrangement of the present invention siphoning off of elevated pressure steam from the top of an exhaust hood and transferring it to the bottom of the exhaust hood is not shown.

U.S. Pat. No. 5,257,906 issued on Nov. 30, 1993 to L. Gray et al., assignors to Westinghouse, entitled "Exhaust System for a Turbomachine" discloses a steam turbine arrangement in which the outer edge of the outer flow guide approaches a vertical orientation and is overall more extended on the bottom and in which an upper baffle within the exhaust hood dissipates the horseshoe-shaped vortex in the upper section and sides of the exhaust hood by "crowding" the vortex against such baffle, thus apparently minimizing formation of such vortex and preventing it from expanding and growing. There is no disclosure of a means for siphoning of fluid from the top portion of the exhaust hood to the bottom portion.

Russian Patent 1,724,903 apparently issued on Apr. 7, 1992, shows a steam turbine arrangement in which a moisture removal slot is provided between the casing and the outer flow guide just upstream of the turbine last stage blade. While it is possible that some steam would also enter such slot or passage, any such steam would be bled off before the last blades into a specially-provided annular passage extending all around the circumference of the turbine well before any subsequent exhaust hood and would not contribute to any significant extent to equalization of pressure in the top and bottom portions of the exhaust hood, which pressure difference is caused by the tortuous path which steam must follow in the top portion of the exhaust hood.

While the problems detrimental to performance of steam turbines associated with the build-up of pressure as well as with the horseshoe-shaped vortex formation in the top portion of a downwardly discharging exhaust hood have been known, and there has been a need to solve such problems, see, for example, the discussion in the background of U.S. Pat. No. 5,257,906 to Gray et al., so far as the present inventor is aware no one has proposed bleeding off a fraction of the steam flow from the top portion and feeding it back into the bottom portion or to the condenser itself nor using a flow by-pass system located over the corners of the hood which tend to produce "separated-flow regions" so as to decrease the pressure differential between the top and bottom portions of a downwardly discharging exhaust hood and to decrease the flow velocity in the top portion upstream of the tortuous path leading to the condenser inlet.

OBJECTS OF THE INVENTION

It is an object of this invention, therefore, to reduce the pressure differential between the top and bottom portions of a downward-discharging exhaust hood of a steam turbine installation by bleeding off, or aspirating, some of the steam from the top portion into the bottom portion or directly to the condenser through a flow by-pass.

It is a further object of the invention to provide a flow by-pass system at the end of a downward-discharging exhaust hood for transferring steam from the top portion of the exhaust hood to the bottom portion in order to decrease the pressure build-up and the flow velocity in the top portion.

It is a still further object of the invention to provide a flow by-pass between the top and bottom portions of a downward-discharging exhaust hood wherein the by-pass has inlets and outlets in the vicinity of the corners located at the end walls of the exhaust hood where normally flow separation occurs, thus not only reducing the pressure differential between the top and bottom portions, but also eliminating such separated flow regions in which energy loss occurs.

It is a still further object of the invention to provide a by-pass for steam from the top portion of a downward-discharging exhaust hood in a steam turbine installation to the condenser region below in which the outlet or outlets are so positioned that steam is aspirated from the top portion to the lower condenser region effectively tending toward equalization of the steam pressure between the top and bottom portions of the exhaust hood.

It is a still further object of this invention to decrease the average pressure drop across a downward-discharging exhaust hood of a steam turbine by decreasing the amount by which the pressure in the top portion of such exhaust hood is raised as a result of turning of steam on its way to the condenser and to reduce energy loss caused by skin friction there and to reduce the separated flow region or regions, in which additional energy loss occurs as a result of friction, thus increasing the amount of work produced by the turbine, that is, increasing its efficiency.

Other objects and advantages of the invention will become evident from the following description and explanation in conjunction with the appended drawings.

SUMMARY OF THE INVENTION

In downward-discharging exhaust hoods of condensing steam turbine installations the exhaust steam entering the top portion of the hood is turned upwardly and then backward and around the sides of the turbine casing toward the condenser positioned under the hood, while the exhaust steam entering the bottom portion of the hood is immediately turned downwardly toward the condenser. The extra 180 degrees of change of flow direction for the steam in the top portion of the hood, which is in fact even larger because of the necessity to flow around the turbine casing, represents in effect a restriction to flow there resulting in a higher pressure in the top portion of the hood than in the bottom portion. This higher pressure is transferred back through the usual diffuser as higher back pressure acting against the steam exiting the turbine resulting in a decrease of the energy available to the turbine to do work and thus in power loss. The higher pressure in the top portion of the exhaust hood is decreased and brought closer to the lower pressure prevailing in the bottom portion of the hood in accordance with this invention by providing a flow by-pass system, or arrangement, between the top portion and either the bottom portion of the exhaust hood or the condenser through which some of the steam from the top portion of the exhaust hood is transported more directly to the lower pressure zone below. The take off locations for steam, or the inlets for steam to the by-pass passages, are preferably located near the upstream edges of the normal "separated flow regions" near the corners of the exhaust hood effectively eliminating such undesirable flow regions. The by-pass conduits, forming internal by-pass passages, are preferably formed by the provision of walls, or plates, within the interior of the end of the exhaust hood, with appropriate inlet and exit openings. The inlet openings are positioned in the higher-pressure zone facing the flowing steam so that steam is pushed or "rammed" into said inlets. The exit openings are located in the lower pressure zone so that steam tends to be aspirated from the flow by-pass passages into such zone. Alternative constructions are possible.

BRIEF DESCRIPTION OF THE DRAWINGS

The nature of the invention will be better understood by reference to the following description, the appended claims, and the views illustrated in the accompanying drawings.

DETAILED DESCRIPTION OF THE INVENTION

Figure 2:
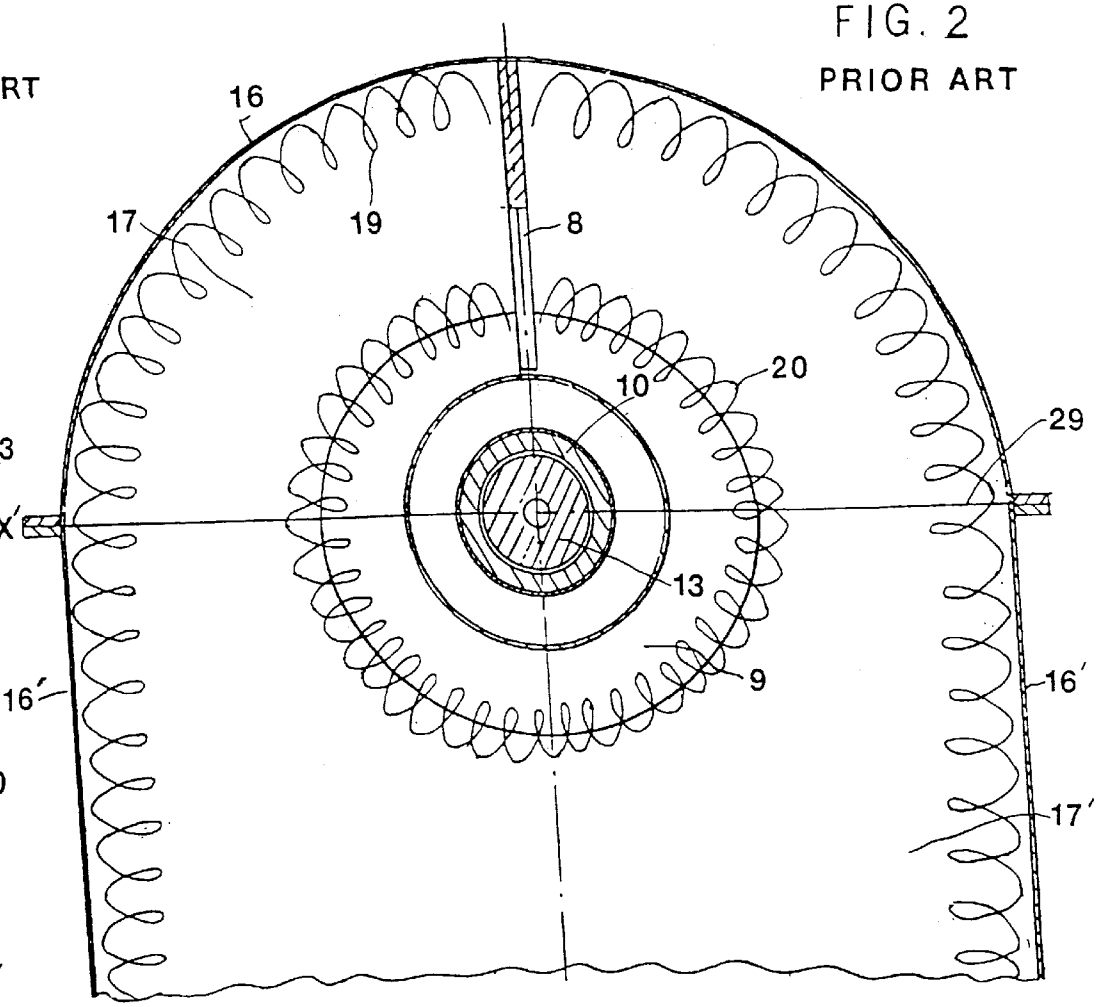
FIG. 2 PRIOR ART
FIG. 2 is a transverse view of the prior art exhaust hood taken along the line A—A of FIG. 1 showing the bearing cone, the end wall, the outer wall of the exhaust hood, and the vortices which generally form in the corners of downward discharging exhaust hoods in vicinity of the end wall.

This invention provides a method and means which bring about a decrease of the pressure rise of steam in the top portion of a downward-discharging exhaust hood of a steam turbine caused by major changes in direction of flow of the exhaust steam. Use of the invention results in an increase of the energy available to the turbine to do work, and a decrease of the energy loss caused by friction there.

The flow by-pass system of the invention is used in connection with a downward-discharging exhaust hood of a steam turbine. It preferably utilizes a by-pass wall located over the corner between the outer and end walls of the exhaust hood, or over the corner around the bearing cone between the bearing cone outside surface and the exhaust hood end wall, or both, to minimize energy loss in the "separated flow regions" which form in these corners. Said by-pass walls are provided with cut-outs forming inlet and outlet vents, or openings, which aided by aspiration at the outlet vents, allow a fraction of steam flowing in the top portion of the exhaust hood to by-pass the exhaust hood passage of the main flow region through flow by-pass passages formed between said by-pass walls and the exhaust hood walls and be conducted directly through said by-pass passages to the bottom portion of the exhaust hood or to the condenser. This prevents such flow fraction from being forced to turn around or reverse direction by the exhaust hood walls into the back portion of the exhaust hood and subsequently around the turbine casing and finally down to the condenser, thus significantly reducing the pressure rise associated with the turning and, in addition, as a consequence of reducing the amount of steam flow in the top portion of the exhaust hood causing its velocity to decrease, which reduction brings about additional reduction of the pressure rise caused by the turning and of energy loss caused by friction, results in an increased efficiency of the turbine.

The prime object of the invention is consequently accomplished by mounting, in a downward-discharging exhaust hood of a steam turbine, one or, preferably, two by-pass walls provided with cut-outs forming inlet and outlet vents which allow by-passing from the top portion of the exhaust hood, with a much smaller change of direction or turning accomplished along a smoother, less tortuous, path and therefore causing a much smaller pressure rise, of a fraction of that steam which is forced to make the largest change of flow direction on its way to the condenser, to the bottom portion of the exhaust hood which is adjacent to the condenser inlet or to the condenser itself. The by-pass of flow at the top of the exhaust hood reduces the velocity of the remaining steam which has to make the largest amount of turning thus making additional contribution to the decrease of the pressure rise associated with the turning and to the energy loss caused by friction. In addition, by being placed in corners of the exhaust hood, the by-pass walls eliminate, or at least greatly reduce the "separated flow regions" and thus make additional energy available to the turbine. One by-pass wall, which will be referred to as the first by-pass wall, is located over the corner between the outer and end walls of the exhaust hood. The other, or the second, by-pass wall is located over the corner around the bearing cone between the bearing cone outside surface and the end wall of the exhaust hood. Each by-pass wall creates a conduit for the by-pass steam flow. Each conduit forms two (by-pass) flow passages, one on each side of the vertical plane of the exhaust hood. The inlet vents of both by-pass walls are located in the top portion of the exhaust hood, while the outlet vents are located in, or in the vicinity of, the bottom portion of the exhaust hood. The by-passing of the flow is aided by aspiration which is produced when the main steam flow flows past the outlet vents of the by-pass walls and the "ram" effect at the inlet vents which are designed so that they face the incoming stream of steam.

Figure 1:
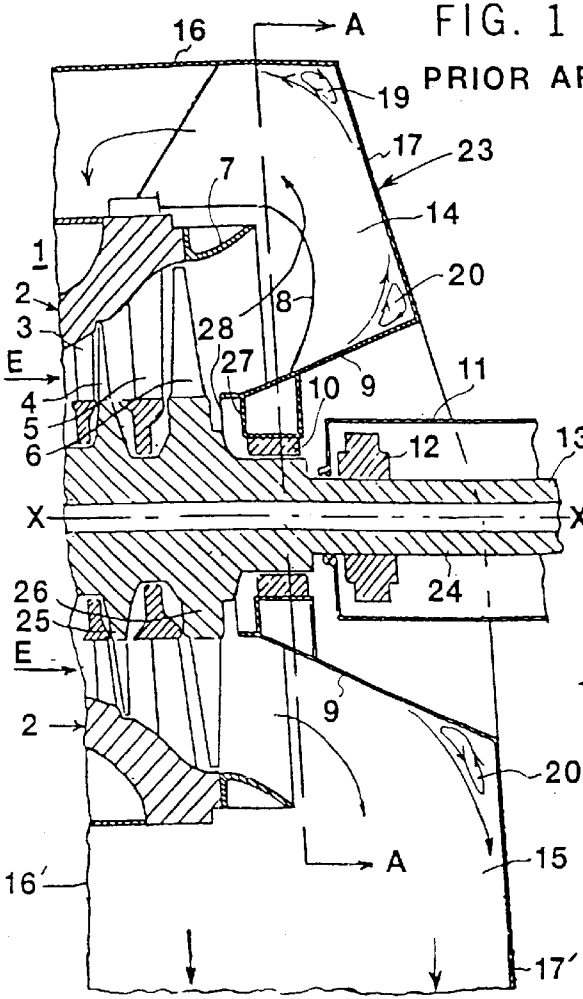
FIG. 1 PRIOR ART
FIG. 1 is a schematic longitudinal, sectional view of an end portion of a prior art multi-stage, axial flow, condensing steam turbine showing the turbine low-pressure end, including the bearing cone and the downward-discharging exhaust hood of the prior art, and, for comparison purposes, illustrating roughly the kind of flow path which steam follows at the top and bottom of the exhaust hood as it flows to the condenser.

In FIG. 1 there is shown an exhaust end of a multi-stage, axial-flow, condensing steam turbine 1. FIG. 2 shows a cross-sectional view of FIG. 1 taken along the line A—A in FIG. 1. FIGS. 1 and 2 are representations of prior art turbine exhaust hood installations shown to establish the construction upon which the improvement of this invention may be added as further shown in FIGS. 3 and 4. Shown in FIGS. 1 and 2 are the "separated flow regions" forming vortices found in many steam exhaust hoods.

Turbine 1 has a casing 2 and flow guide 7 mounted on the end of the casing 2. Surrounding the casing is an exhaust hood 23 composed of a top portion 14 having end wall 17 and outer wall 16, and a bottom portion 15 having end wall 17' and outer wall 16'. End walls 17 and 17' together represent the end wall of the exhaust hood 23, while the outer walls 16 and 16' together represent the outer wall of the exhaust hood 23. The bottom portion 15 extends downwardly to and connects with a condenser, not shown. The exhaust hood portion surrounding turbine casing 2 will be called the "back portion", and the portion surrounding the bearing cone 9 will be called the "front portion."

Extending through turbine casing 2 and the exhaust hood 23 is turbine shaft 13 having central longitudinal axis X–X' and outer portion 24 mounted in bearing 12. Attached to turbine shaft 13, at spaced intervals, are turbine disks 25 and 26 and fastened to each such disk are turbine blades or turbine blade rows 4 and 6, respectively. In front of the turbine blade rows 4 and 6 are positioned nozzle rows 3 and 5, respectively, frequently referred to as stationary blades that serve to better direct the steam upon the rotatable blades of the turbine.

As shown in FIG. 1, flow guide 7 extends from casing 2 of the turbine to which it is fastened. Such flow guide conventionally extends for 360 degrees circumferentially about shaft longitudinal axis X–X' into exhaust hood 23. It is made up of two portions, a top portion and a bottom portion, which are joined in the plane of the exhaust hood horizontal joint 29 shown in FIG. 2.

Extending from adjacent turbine disk 26 is bearing cone 9 which has the shape of a truncated cone which surrounds turbine shaft outer portion 24 and bearing 12 enclosed by bearing cover 11. The bearing cone is a part of the exhaust hood 23. Bearing cone 9 has an outside surface facing flow guide 7 and an inside surface facing bearing cover 11. Extending from bearing cone 9 is a bearing cone inner plate 27 adjacent bearing cone inner end 28. Mounted centrally of bearing cone inner plate 27 is shaft seal 10 which acts to prevent flow of air into exhaust hood 23 along turbine shaft 13.

Extending from bearing cone 9, along end wall 17 of exhaust hood top portion 14 and outer wall 16 is located, in many turbines, vertical rib 8. Such rib is shown in FIG. 1 and FIG. 2. Rib 8 serves to reinforce the outer wall 16 and stiffen the upper portion of the exhaust hood.

Steam flows in the turbine from left to right as indicated by arrows E in FIG. 1, through turbine casing 2, turbine blade rows 4 and 6 to exhaust hood top and bottom portions 14 and 15 and then downward to a condenser, not shown.

Also shown in FIGS. 1 and 2 are the "separated flow regions" which form in the corners of the exhaust hood and which are eliminated by the corner by-pass walls of this invention. Region 19 with the associated horseshoe shaped vortex is located in the corner between the end wall 17 and the outer wall 16 and between the end wall 17' and the outer wall 16', while region 20 with its vortex is located in the corner between the bearing cone outside surface and the end walls 17 and 17'.

Figure 3:
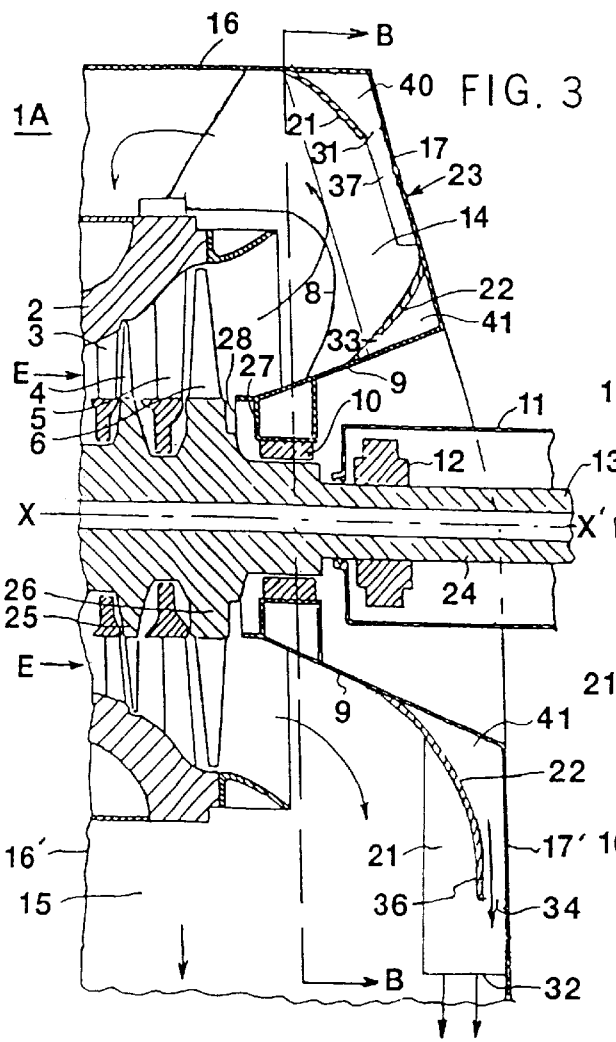
FIG. 3 is a schematic longitudinal, sectional view of an end portion of a multi-stage, axial-flow, condensing steam turbine corresponding generally to that of FIG. 1 showing the flow by-pass system of this invention composed of two conduits and illustrating the exhaust flow pattern which is modified by the two by-pass walls, namely the first and the second by-pass walls, of this invention.

Referring to FIG. 3, there is shown a schematic view of an exhaust end of a multi-stage, axial-flow, condensing steam turbine 1A having a design comparable to, and elements common with turbine 1 of FIG. 1 and incorporating the preferred embodiment of this invention. Common numerals have been employed in FIG. 3 and FIG. 1 when applicable.

Turbine 1A has casing 2 and flow guide 7 as in FIG. 1. Surrounding the casing is exhaust hood 23 composed of top portion 14 having end wall 17 and outer wall 16 and bottom portion 15 having end wall 17' and outer wall 16'. The end walls 17 and 17' together represent the end wall of exhaust hood 23, while the outer walls 16 and 16' together represent the outer wall of the exhaust hood 23. The bottom portion 15 connects with a condenser, not shown. The top portion 14 and the bottom portion 15 are joined by a horizontal joint 29, see both FIG. 2 and FIG. 4.

Extending through turbine casing 2 and exhaust hood 23 is turbine shaft 13 having central longitudinal axis X–X' and outer portion 24 mounted on bearing 12 enclosed by cover 11, as in FIG. 1. Attached to turbine shaft 13, at spaced intervals, are turbine disks 25 and 26 and fastened to each such disk is turbine blade row 4 and 6, respectively. In front of the turbine blade rows 4 and 6 are nozzle rows 3 and 5, respectively.

As will be understood from FIG. 3, flow guide 7 extends from casing 2 of the turbine, to which it is fastened, for 360 degrees circumferentially about the shaft longitudinal axis X–X' into exhaust hood 23.

Extending from adjacent turbine disk 26 is bearing cone 9, which has a shape of a truncated cone, and which surrounds turbine shaft outer portion 24 and bearing 12. Bearing cone 9 has outside surface facing flow guide 7 and inside surface facing bearing cover 11. Extending from bearing cone 9 is bearing cone inner plate 27 adjacent bearing cone inner end 28. Mounted centrally of bearing cone 9 along end wall 17 of the hood top portion 14 and the outer wall 16 is located, in many turbines, vertical rib 8. Such rib is shown in FIG. 3 and in FIG. 4. As indicated, this is all similar or identical to what is shown in FIG. 1.

As in FIG. 1 and FIG. 2, steam flows in or through the turbine from left to right as indicated by arrows E in FIG. 3, through turbine casing 2, turbine blade rows 4 and 6, to exhaust hood top and bottom sections 14 and 15 and then downward to a condenser, not shown.

The preferred embodiment of this invention incorporates two distinct flow by-pass conduits, conduits 40 and 41 shown in FIG. 3. The first by-pass conduit, conduit 40, is formed between the (first) by-pass wall 21 which is positioned over or in the corner formed between the outer and end walls of the exhaust hood, that is, between outer wall 16 and end wall 17 of the top portion and between outer wall 16' and end wall 17' of the bottom portion of exhaust hood 23 where "separated flow regions" may be found as shown in FIG. 1 and FIG. 2. The by-pass wall 21 is made up of two portions, one located in the top portion and one in the bottom portion of the exhaust hood. These portions are joined or abut in the plane of the exhaust hood horizontal joint 29. In turbine exhaust hood installations in which rib 8 is present, the by-pass wall 21 is separated in the top portion of the hood by the rib. The by-pass wall 21 extends some distance into bottom portion 15 of the exhaust hood although it may be extended into the condenser below. The second by-pass conduit, conduit 41, is formed between the (second) by-pass wall 22 which is positioned over the corner formed between the outside portion of bearing cone 9 and the exhaust hood end wall. By-pass wall 22 is also made up of two portions, one located in the top portion and one in the bottom portion of the exhaust hood, the two portions being joined or abutting in the vicinity of the plane of the exhaust hood horizontal joint 29. Each by-pass conduit forms two flow by-pass passages, one on each side of the exhaust hood as viewed along the turbine longitudinal axis X–X', through which by-passed steam flows.

Figure 4:
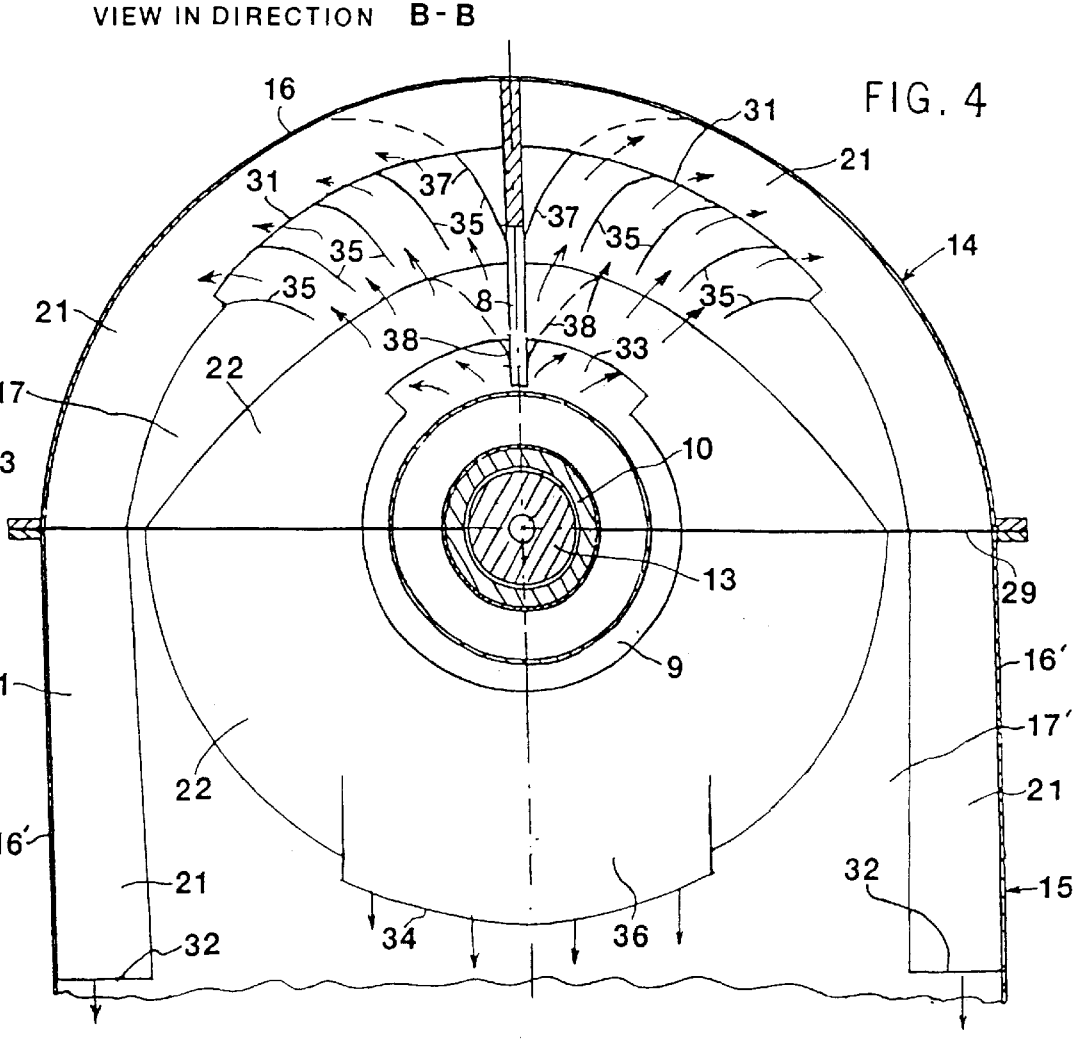
FIG. 4 is a transverse sectional view taken along line B—B of FIG. 3 illustrating two by-pass walls which form partial boundaries of the flow conduits of this invention and showing the inlet and outlet vents or ports of the by-pass walls.
Figure 5:
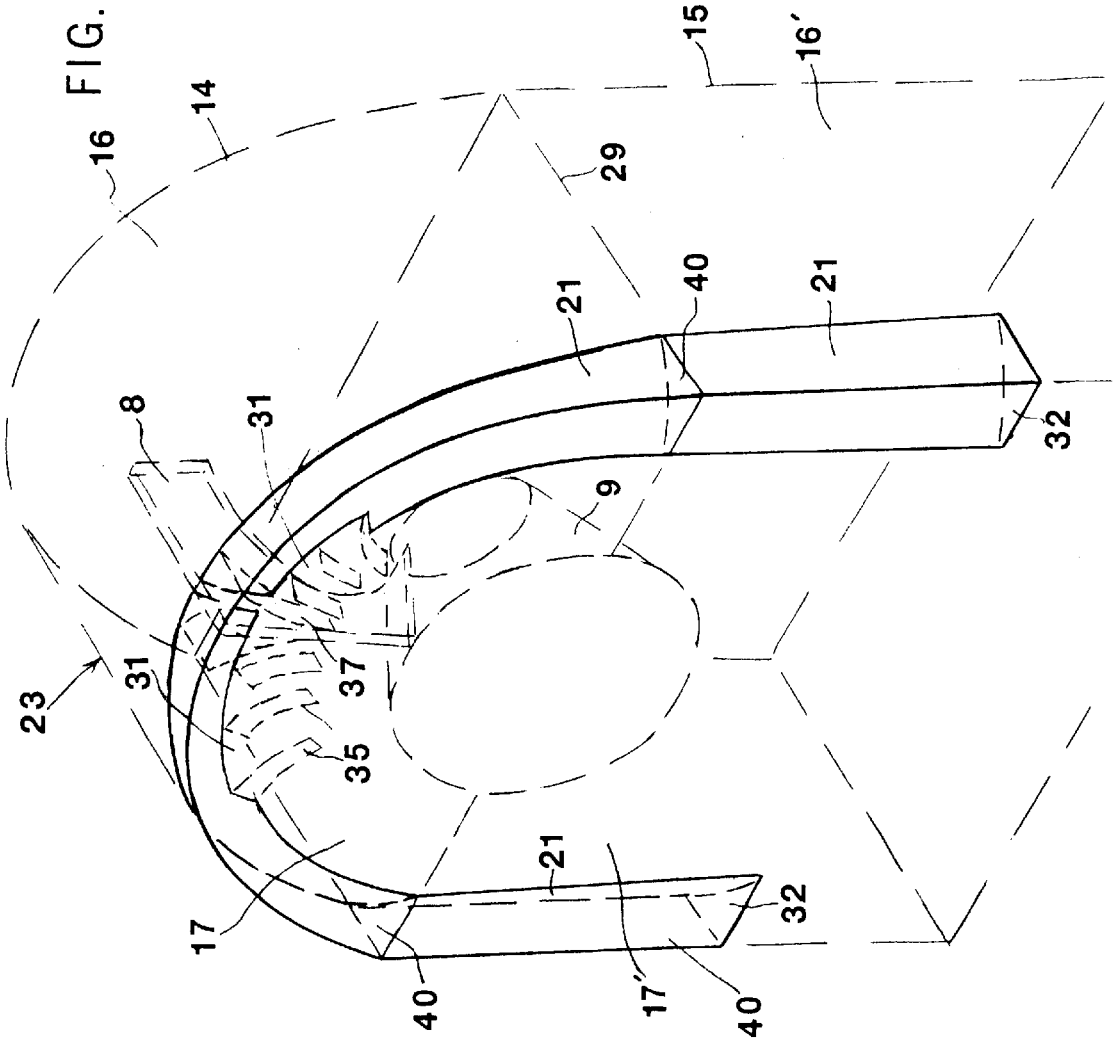
FIG. 5 is a perspective view of the first by-pass conduit which forms two flow passages located in the vicinity of the corner between the end and outer walls of the exhaust hood, one on the left side and one on the right side of the exhaust hood of this invention when viewed along the turbine axis.

By-pass wall 21, shown in FIG. 3 and FIG. 4, is shown in perspective view in FIG. 5. As shown, the by-pass conduit 40 has in the top portion of the exhaust hood an inlet vent 31 which is separated into two parts by rib 8 in turbines in which such rib is present, and, in the bottom portion of the exhaust hood it has two outlet vents 32. By-pass conduit 40, which is bounded by by-pass wall 21 and the exhaust hood end and outer walls, extends from the top of the exhaust hood around the sides and downwardly to exhaust into the bottom portion of the exhaust hood. To assist in decelerating the by-pass flow and thus to further lower the pressure in the top portion of the exhaust hood, the cross-sectional area of the flow by-pass conduit 40 should preferably increase at least slightly in the downstream direction toward the condenser, as shown.

At the inlet vent 31 of by-pass conduit 40, starting, preferably, in front of the inlet 31 there is preferably a flow guide or vane 37 mounted symmetrically about the vertical plane to facilitate turning the incoming steam flow into the by-pass conduit 40 as shown in FIGS. 3, 4, and 5. The by-pass wall 21 at inlet vent 31 should, preferably, have its leading edge rounded to mitigate generation of noise there.

In front of the inlet vent 31 of by-pass wall 21 are preferably located curved flow guide vanes 35 whose purpose is to guide the steam through the inlet vent into the passages of by-pass conduit 40 formed between the by-pass wall and the exhaust hood walls on both sides of the vertical rib 8, as shown in FIGS. 4 and 5.

As will be seen, therefore, in a preferred form of the invention, a by-pass plate or wall 21 is mounted angularly across the intersection of the end wall and outer wall of a downward-discharging exhaust hood to form a more or less triangular shaped conduit 40 around the periphery of the top portion of an exhaust hood and well down into the bottom portion of the exhaust hood. One or more vents or inlets are provided in the upper portion of the by-pass plate or wall 21 to provide access of exhaust steam from the upper portion of the exhaust hood into the conduit 40 from which this relatively elevated pressure steam may travel through two passages on left and right sides of conduit 40 and exit through exhaust vents 32 at the lower ends of the conduit into the bottom portion of the exhaust hood or directly into the condenser where the steam pressure is less. Preferably the upper vent or inlet 31 of conduit 40 is provided with guide vanes 37 and 35 to help the steam turn into and downwardly through the conduit passage 40 to exhaust at the end through outlet openings or vents 32. The by-passing of a fraction of the steam from the upper portion of the exhaust hood in a more directly configured way into the bottom of the exhaust hood, or directly to the condenser, which results in a significant decrease of the amount of flow and velocity of steam which must follow a tortuous path on its way to the condenser, will reduce the pressure in the top portion of the exhaust hood. Such reduction of pressure will be reflected back through the annular diffuser to the exit of the turbine allowing the turbine to operate against a smaller back-pressure thus increasing the energy available for the turbine to do work and increasing its efficiency.

The by-pass conduit 40 is preferably aided in reducing the pressure in the top portion of the exhaust hood by the use of a second by-pass conduit at the front portion of the exhaust hood essentially covering over the "separated flow region" normally present in the corner between the bearing cone and the end wall in the front portion of the exhaust hood. A preferred form of such by-pass conduit is shown in FIGS. 3 and 4. The plate or wall 22, which extends over a significant portion of the front of the exhaust hood outside of the bearing cone 9 on the outside of which the by-pass plate or wall 22 is mounted, is placed against the end wall of the exhaust hood.

Figure 6:
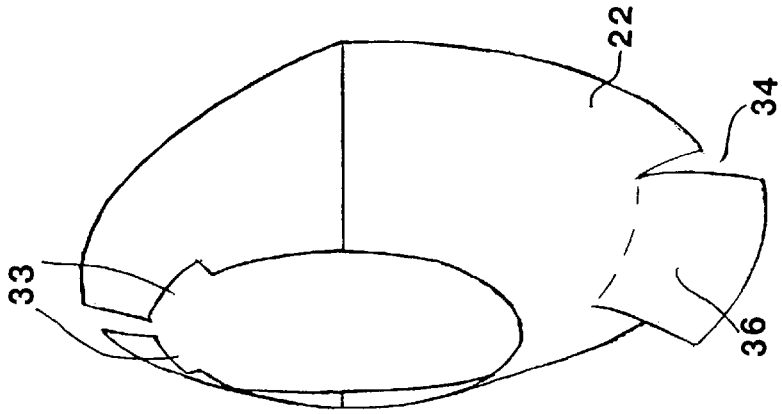
FIG. 6 is a perspective view of the second by-pass wall located in the vicinity of the corner around the bearing cone between the bearing cone outer surface and the end wall of the exhaust hood which forms a partial boundary of the second by-pass conduit having two flow passages extending downwardly from the top portion of the exhaust hood to the bottom portion on opposite sides of the hood around the bearing cone.

By-pass wall 22, shown in FIG. 3 and FIG. 4 and in perspective view in FIG. 6, has inlet vent 33 located in the bottom of the upper portion of the wall 22 in the top portion of the exhaust hood, which may be separated into two parts by rib 8, and outlet vent 34 located in the bottom portion of the exhaust hood, as shown. Bounded by the by-pass wall 22 and the exhaust hood bearing cone and the end wall is the flow by-pass conduit 41. At the inlet to the by-pass conduit 41, starting in the vicinity of the inlet vent 33, see FIG. 4, there is preferably located flow guide or guide vane 38 preferably mounted symmetrically with respect to the vertical plane to facilitate turning of the incoming flow into the by-pass conduit 41. The lower portion of the guide 38 visible through inlet vent 33 in FIG. 4 is shown in solid lines, while the remainder of such guide or guides behind the by-pass wall or plate 22 is shown in dashed lines.

Curved guide vanes, similar to flow guide vanes 35 in front of inlet 31 of by-pass wall 21, can also be placed in front of inlet 33 of by-pass wall 22 to facilitate inflow of steam to the by-pass conduit around the bearing cone.

As is shown in FIG. 3 and FIG. 6, by-pass wall 22 at the outlet vent 34 has a lip or shroud 36 shaped so that it directs the flow from the by-pass conduit 41 in a generally downward direction toward the condenser. By extending downward for some distance in a direction parallel and adjacent to the end wall 17', lip 36 prevents the main flow of steam in the bottom portion of the exhaust hood from impinging at an angle on the flow exiting the outlet vent 34 and thereby enhances aspiration at such outlet.

In the preferred embodiment of this invention, the inlet vents of both by-pass walls extend approximately over the upper quadrant of the exhaust hood, that is, over approximately a 90 degree angle, symmetrically with respect to the vertical plane to approximately +45 degrees and −45 degrees from the vertical plane as shown in FIG. 4. The outlet vent 34 of by-pass wall 22, which is also placed symmetrically with respect to the vertical plane, extends preferably over approximately 60 degrees total angle or about 30 degrees on either side of the vertical plane.

The by-pass conduit located or positioned around the bearing cone by-passes preferably about 10 percent of the flow from the upper quadrant portion of the exhaust hood, while the by-pass conduit located at the corner between the outer and end walls of the exhaust hood preferably by-passes about 20 percent of the flow from the upper quadrant of the exhaust hood. Thus a preferable total amount of steam by-passed is approximately 30 percent of the total of steam flow from the upper quadrant of the exhaust hood, or 7.5 percent of total steam flow through a turbine exhaust end. This would result in a decrease of the average flow velocity of steam in the upper quadrant of the exhaust hood which must follow a tortuous path to the condenser to 70 percent of the velocity which would exist without the flow by-pass system. Since the pressure rise and energy losses are roughly proportional to the square of the flow velocity, this means that, for the amount of steam flow by-pass being considered, the pressure rise and energy losses in the top portion of the exhaust hood should be decreased by approximately 50 percent.

Figure 8:
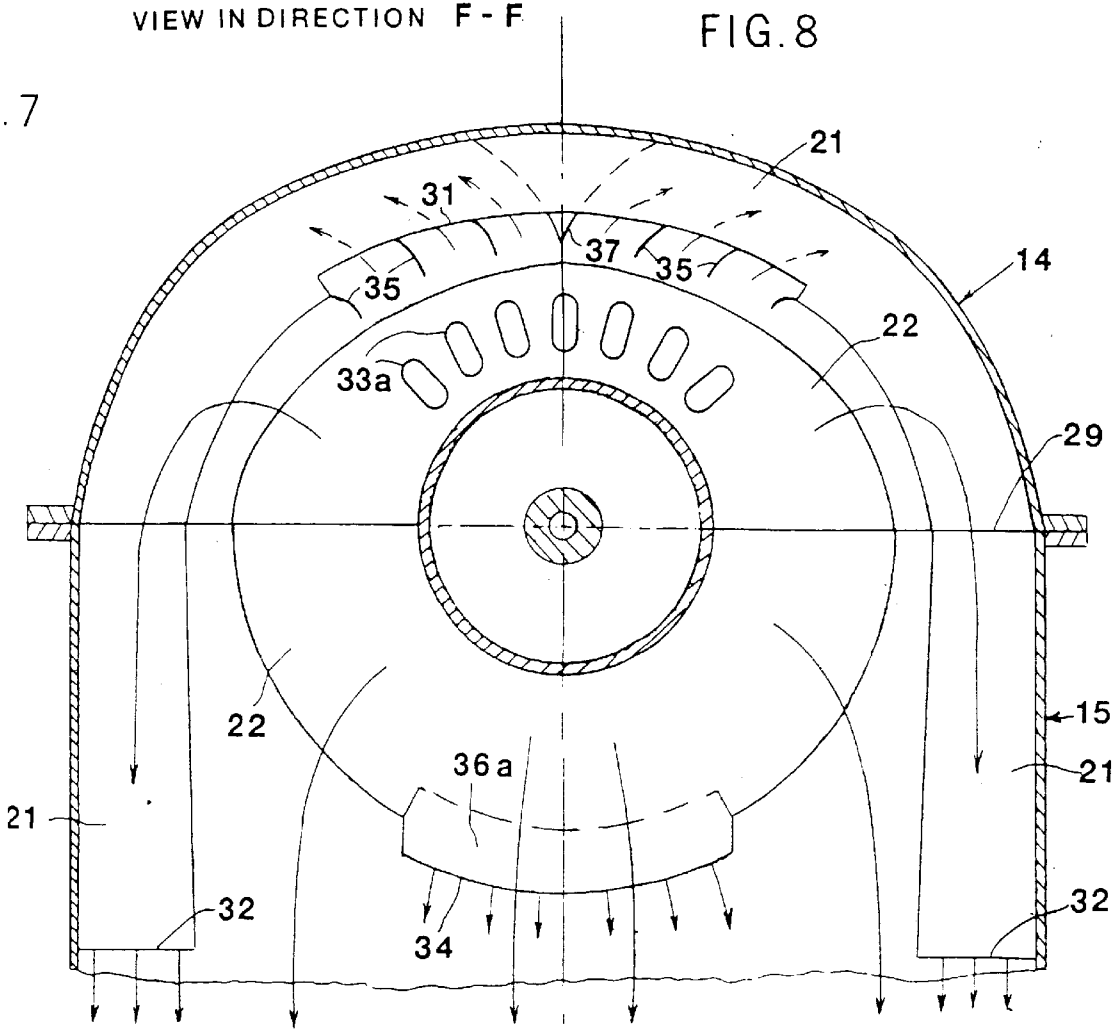
FIG. 8 is a transverse sectional view along line F—F of FIG. 7 illustrating the inlet and outlet vents of the first and second by-pass conduits.
Figure 7:
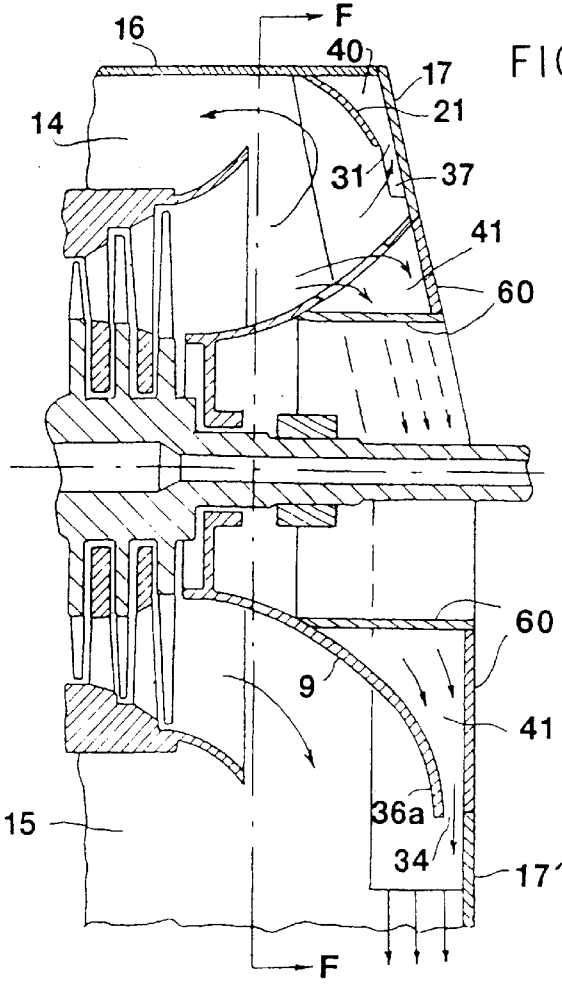
FIG. 7 is a schematic longitudinal, sectional view of an end portion of a multistage, axial-flow, condensing steam turbine similar to that shown in FIG. 3 except that in this design the bearing cone is inwardly concave so that its shape approximates the second by-pass wall of this invention. In such case, the outer portion of the bearing cone adjacent the end walls of the exhaust hood becomes the second by-pass wall of this invention and the second by-pass conduit of the system is created by adding an enclosure inside the bearing cone as shown. The inlet vent to the second by-pass conduit in this case can be in form of a slot like the one shown in FIG. 4 or be made in the form of a number of longitudinal slots as shown in FIG. 8. The outlet vent from the second by-pass conduit can be in form of a slot placed adjacent to the exhaust hood end wall with a lip added, similar to the one shown in FIG. 3. The first by-pass wall and the first by-pass conduit together with its inlet and outlet vents in this case are the same as illustrated in FIG. 3 and FIG. 4.

An alternative embodiment of the invention is shown in FIG. 7, in which the bearing cone of a steam turbine is inwardly curved or concave as viewed from the outside approximating the shape of the bearing cone shown in FIG. 1 with the second by-pass wall, wall 22, mounted on it as shown in FIG. 3. In such case, the bearing cone outer portion adjacent the end wall of the exhaust hood becomes the second by-pass wall of this invention, wall 22, and the by-pass conduit 41 is created by attaching from the outside a further enclosure 60 in the form of a continuous annular structure to the inner side of the bearing cone around the outer portion of the turbine shaft. The inlet vent of the by-pass wall can then be made in the form of a number of cut-out oval slots, or openings, 33*a*, as shown in FIG. 8, or be in form of a slot much like the inlet vent 33 shown in FIG. 4 in which case it can be provided with flow guide 38 similar to that shown in FIG. 4. The outlet vent 34 of the by-pass wall should be provided with lip 36*a* attached to bearing cone 9 to protect the by-pass flow from being impinged upon by the main steam flow and thus to promote and preserve aspiration there, much like in the design illustrated in FIG. 3 and FIG. 4. The first by-pass wall, wall 21, and the first by-pass conduit having inlet vent 31, outlet vents 32, and flow guide vanes 35 and 37 is, in this case, like the one shown in FIGS. 3 and 4. Alternatively, the same arrangements of slots 33*a* shown in the by-pass wall as illustrated in FIG. 8 could be used in the arrangement shown in FIGS. 3 and 4 rather than the inlet vent 33 shown in FIGS. 3 and 4. Depending upon the outer angle of the bearing cone this would be closely equivalent to the arrangement shown in FIGS. 7 and 8 but somewhat decreases the desirable vane effect of the preferred arrangement shown in FIGS. 3, 4, and 5.

By-pass walls 21 and 22 can have curved or straight shapes or transverse profiles. Although they are more costly to manufacture and to install, curved shapes or profiles are preferred because they can conform closely to the flow path which the steam tends to take outside the "separated flow regions" and therefore can completely eliminate such regions and associated losses.

Figure 9:
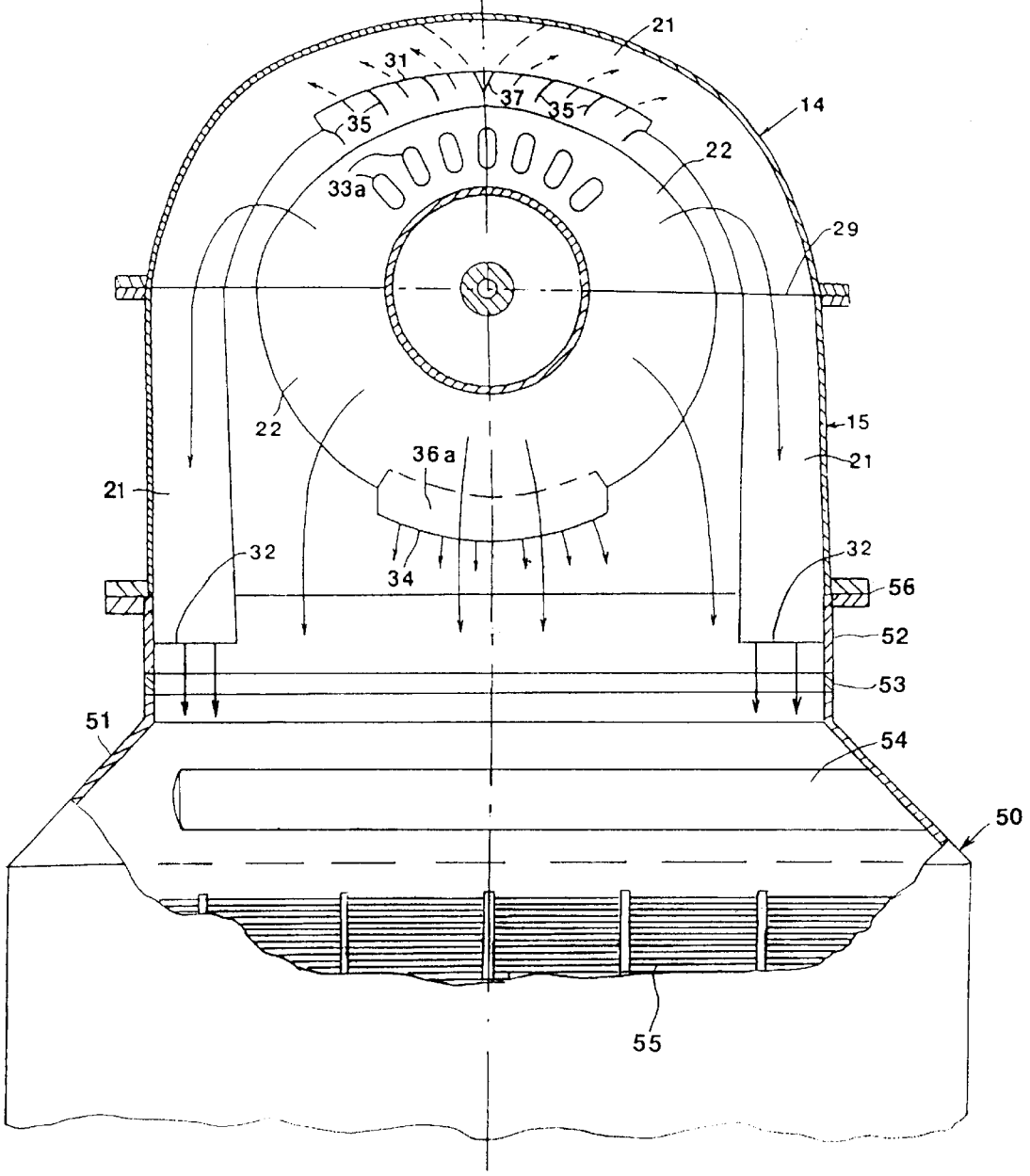
FIG. 9 is a transverse sectional view similar to FIG. 8 showing the by-pass conduits on the outer radius of the exhaust hood leading directly into the top of a condenser.

FIG. 9 shows the arrangement of FIGS. 7 and 8 with the by-pass wall 21 and the by-pass conduit 40 behind it leading directly downwardly into a lower condenser 50 positioned under the exhaust hood. The condenser 50 shown is partly broken away to show some of the condensing water tubes 55. Also shown is a condenser neck 51 in which there usually is located a number of low-pressure (LP) heaters, such as the LP heater 54 shown. Above the condenser neck 51 there normally is a condenser neck extension 52, containing an expansion joint 53, which connects with the exhaust hood lower portion with the aid of a condenser flange 56. The by-pass conduit which is formed with the aid of the by-pass walls 21 extends into the condenser neck extension 52 where the steam by-passed from the top portion of the hood exhausts through vents 32. No conduit for direct passage of exhaust steam from the bottom of the by-pass plate 22 from vent 34 to condenser neck extension 52 is shown, but it will be understood that such a by-pass conduit could be easily provided. The remainder of FIG. 9 is similar or identical to FIG. 8 and the operation is otherwise similar.

The flow by-pass conduits utilizing by-pass walls of this invention can be used in both conventional exhaust hoods and also in exhaust hoods utilizing the adjustable guide vanes described in U.S. Pat. No. 5,209,634 entitled "Adjustable Guide Vane Assembly for the Exhaust Flow Passage of a Steam Turbine". In such case, the inlet vent or vents made in the by-pass wall 22, if such by-pass is used, should preferably be placed in the top portion of the exhaust hood above the adjustable guide vane.

To recapitulate, as a result of by-passing of a fraction of steam from the top portion of the exhaust hood to the bottom portion in a system which utilizes the by-pass walls of this invention, the performance of a steam turbine having a downward-discharging exhaust hood is improved for the following three reasons:

As a result of the by-pass of flow from the top portion of the exhaust hood, the rate of flow of steam and the average flow velocity there are decreased which results in a smaller pressure rise associated with turning of the flow of steam and in smaller energy losses caused by friction, A fraction of steam from the top portion of the exhaust hood is by-passed to the bottom portion along paths which require reduced amounts or degrees of change of direction, or turning, aided by diffusion within the by-pass conduits and aspiration at conduit outlets and thus causes smaller pressure rise in the exhaust hood, and As a result of being placed over corners, the by-pass walls eliminate, or, at least greatly reduce the "separated flow regions" in which vortices otherwise form and thus reduce the amount of energy loss caused by friction associated with such flow regions.

While the flow by-pass conduits of this invention have been described in a preferred manner, the description has been simplified by avoiding reference to construction details, since the by-pass walls can be made in various manners including construction from a number of separate sections joined together. It is to be further recognized that modifications and variations of this invention can be made by those skilled in art without departing from the spirit and scope thereof as defined by the appended claims.

I claim:

1. A flow by-pass system for a downwardly discharging exhaust hood having top and bottom portions in a steam turbine installation wherein exhaust steam is normally initially directed mostly upwardly from an upper portion of an annular diffuser in the front of the top portion of the exhaust hood, then into the back of the top portion and downwardly on both sides of a casing of the turbine into the bottom portion of the exhaust hood from which it flows into a condenser adjacent the bottom portion, while the steam from the lower portion of the annular diffuser is directed immediately mostly downwardly to the bottom portion of the exhaust hood and into the condenser resulting in a higher pressure in the upper portion of the hood and lower pressure in the lower portion of the hood, which higher pressure in the upper portion of the hood tends to be transferred back to the turbine, the improvement comprising a by-pass conduit arranged to conduct a portion of the steam from the top, higher pressure, portion of the exhaust hood to a lower pressure zone below it by a more direct route than that followed by the normal flow of steam to decrease the build-up of pressure in the top portion of the exhaust hood which decrease causes an increase in the energy available to the turbine to do work and to decrease flow velocity in the upper portion of the hood to reduce the energy loss caused by friction and thus to increase turbine efficiency, said by-pass conduit being provided with at least two flow passages extending downwardly from the top portion of the exhaust hood on the opposite sides of the exhaust hood and wherein the by-pass conduit comprises an interior wall attached to outer and end walls of the exhaust hood to enclose a corner of the hood between the outer and end walls of said hood to convert at least portions of such corner into two enclosed flow passages.

2. A flow by-pass system for an exhaust hood in accordance with claim 1 wherein the lower pressure zone to which the conduit conducts a portion of the steam from the top portion of the exhaust hood is the bottom portion of the exhaust hood.

3. A flow by-pass system for an exhaust hood in accordance with claim 1 wherein the lower pressure zone to which the conduit conducts a portion of the steam from the top portion of the exhaust hood is the condenser.

4. A flow by-pass system for an exhaust hood in accordance with claim 1 wherein the by-pass conduit has at least one inlet in the top portion of the exhaust hood and two outlets.

5. A flow-by-pass system for a downwardly discharging exhaust hood having top and bottom portions, an end wall and an outer wall, and a bearing cone in a steam turbine installation in the form of a by-pass conduit provided with at least two flow passages extending downwardly from the top portion of the exhaust hood on the opposite sides of the exhaust hood and comprising an interior wall attached to the end wall of the exhaust hood and to the outside surface of the bearing cone to enclose the corner of the hood between the outside surface of the bearing cone and the end wall of the hood to convert such corner into two enclosed flow passages, said by-pass conduit having at least one inlet located in the top portion of the hood with the inlet or inlets of the conduit being provided with steam directing vanes.

6. A flow by-pass system for an exhaust hood in accordance with claim 5 wherein an outlet of the conduit is provided with a flow directing lip to enhance aspiration of steam from the by-pass conduit.

7. A flow by-pass system for an exhaust hood downwardly discharging into a condenser in a steam turbine installation, said exhaust hood having an end wall and an outer wall and a bearing cone and being divided into top and bottom portions, comprising:

(a) an interior by-pass wall located over the corner between the outer wall and the end wall of the exhaust hood forming a conduit between the by-pass wall and the outer and end walls of the exhaust hood;

(b) an interior by-pass wall mounted over the corner between the bearing cone outside surface and the end wall of the exhaust hood forming a conduit between the by-pass wall, the bearing cone, and the end wall of the exhaust hood;

(c) wherein each by-pass wall is provided with at least one inlet vent to each conduit in the top portion of the exhaust hood and at least one outlet vent below it, to conduct a portion of steam from the top, higher pressure, portion of the exhaust hood to the lower pressure zone below it, whereby the build-up of pressure in the top portion of the exhaust hood is decreased, thus increasing the energy available for the turbine to do work and to decrease energy loss caused by friction and thus to increase turbine efficiency.

8. A flow by-pass system for an exhaust hood in accordance with claim 7 in which the lower pressure zone to which the conduit formed between the by-pass wall mounted over the corner between the outer and end walls of the exhaust hood conducts a portion of the steam from the top portion is the bottom portion of the exhaust hood.

9. A flow by-pass system for an exhaust hood in accordance with claim 7 in which the lower pressure zone to which the conduit formed between the by-pass wall mounted over the corner between the outer and end walls of the exhaust hood conducts a portion of the steam from the top portion is the condenser located below the exhaust hood.

10. A flow by-pass system for an exhaust hood in accordance with claim 7 wherein each by-pass conduit comprises two flow passages on opposite sides of the exhaust hood.

11. A flow by-pass system for an exhaust hood in accordance with claim 7 having flow guides in vicinity of the inlet vent of the by-pass wall mounted over the corner between the outer wall and the end wall of the exhaust hood.

12. A flow by-pass system for an exhaust hood in accordance with claim 7 in which the by-pass wall mounted over the corner between the outer wall and the end wall of the exhaust hood has a rounded leading edge at the entrance to the inlet vent to mitigate generation of sound there.

13. A flow by-pass system for an exhaust hood in accordance with claim 12 in which the cross-sectional areas of the flow passages of the by-pass conduit formed between the by-pass wall mounted over the corner between the outer and end walls of the exhaust hood increase in the bottom portion of the hood in the downward direction toward the condenser to produce diffusion of flow in the conduit and, consequently, lowering of pressure at the inlet to the conduit and thus to enhance withdrawal of steam from the top portion of the exhaust hood.

14. A flow by-pass system for an exhaust hood in accordance with claim 7 in which the by-pass wall mounted over the corner between the outer and end walls of the exhaust hood is divided into two portions by a rib located in the top portion of the exhaust hood.

15. A flow by-pass system for an exhaust hood in accordance with claim 7 in which the by-pass wall mounted over the corner between the bearing cone outside surface and the end wall of the exhaust hood is in form of a truncated conical surface.

16. A flow by-pass system for an exhaust hood in accordance with claim 7 in which the by-pass wall mounted over the corner between the bearing cone outside surface and the end wall of the exhaust hood has a cut-out provided to accommodate a rib located in the top portion of the exhaust hood.

17. A flow by-pass system for an exhaust hood in accordance with claim 7 having flow guides located in vicinity of the inlet vent of the by-pass wall mounted over the corner between the bearing cone outside surface and the end wall of the exhaust hood.

18. A flow by-pass system for an exhaust hood in accordance with claim 7 in which the by-pass wall mounted over the corner between the bearing cone outside surface and the end wall of the exhaust hood has a rounded leading edge at the entrance to the inlet vent to mitigate generation of sound there.

19. A flow by-pass system for an exhaust hood in accordance with claim 7 in which the by-pass wall mounted over the corner between the bearing cone outside surface and the end wall of the exhaust hood has an inlet in form of a plurality of openings.

20. A flow by-pass system for an exhaust hood in accordance with claim 7 in which the by-pass wall mounted over the corner between the bearing cone outside surface and the end wall of the exhaust hood has an outlet vent located in the vicinity of the end wall in the bottom portion of the exhaust hood which has a flow directing lip provided to enhance aspiration of flow from the conduit.

21. A flow by-pass system for an exhaust hood downwardly discharging into a condenser and having top and bottom portions and an end wall and an outer wall in a steam turbine installation comprising a by-pass conduit formed by a wall located within the exhaust hood over the corner between the outer and end walls and extending into the bottom portion of the exhaust hood having at least one inlet vent and at least two outlet vents and forming two flow passages one on each side of the exhaust hood to conduct a portion of steam from the top, higher pressure, portion of the exhaust hood to the bottom portion below it whereby the build-up of pressure in the top portion of the exhaust hood is decreased thus increasing the energy available to the turbine to do work and to decrease energy loss caused by friction and thus to increase turbine efficiency.

22. A flow by-pass system for an exhaust hood in accordance with claim 21 in which the cross-sectional areas of the two flow passages of the by-pass conduit increase in the bottom portion of the hood in the downward direction toward the condenser to produce diffusion of flow in the conduit and, consequently, lowering of pressure at the inlet to the conduit and thus to enhance withdrawal of steam from the top portion of the exhaust hood.

23. A flow by-pass system of claim 21 in which the by-pass wall has a rounded leading edge at the entrance to the inlet vent to mitigate generation of sound there.

24. A flow by-pass system for a downwardly discharging exhaust hood in a steam turbine installation, said exhaust hood having a bearing cone and an end wall and being divided into top and bottom portions, comprising a by-pass conduit formed by a wall located over the corner between the bearing cone outside surface and the end wall of the exhaust hood and having at least one inlet vent located entirely in the top portion of the exhaust hood and at least one outlet vent located in the bottom portion of the exhaust hood, to conduct a portion of steam from the top, higher pressure, portion of the exhaust hood to the bottom portion below it to decrease the build-up of pressure in the top portion of the exhaust hood which build-up results in a decrease of the energy available to the turbine to do work and to decrease energy loss caused by friction and thus to increase turbine efficiency.

25. A flow by-pass of claim 24 in which the outlet vent, or vents, are provided with a lip to enhance aspiration of steam from the top portion of the exhaust hood.

26. A flow by-pass system for a downwardly discharging exhaust hood in a steam turbine installation, said exhaust hood having an inwardly curved bearing cone and an end wall and top and bottom portions, comprising a by-pass conduit formed by a wall of the outer portion of the bearing cone adjacent the end wall of the exhaust hood and an annular enclosure attached from the outside to the bearing cone inside surface wall, with at least one inlet and at least one outlet vent being cut out in the bearing cone wall itself, to conduct a portion of steam from the top, higher pressure, portion of the exhaust hood to the bottom portion below it to decrease the build-up of pressure in the top portion of the exhaust hood thus increasing the energy available to the turbine to do work and to decrease energy loss caused by friction and thus to increase turbine efficiency.

27. A flow by-pass system for a downwardly discharging exhaust hood in a steam turbine installation, said exhaust hood having an inwardly curved bearing cone, top and bottom portions, an end wall and an outer wall, said system comprising one by-pass conduit, having inlet and outlet vents, formed by the inside wall of the outer portion of the bearing cone and an annular enclosure attached from the outside to the bearing cone inside wall, and another by-pass conduit formed by a by-pass wall mounted inside the exhaust hood over the corner between the outer and end walls of the hood and having at least one inlet vent and two outlet vents, to conduct a portion of steam from the top, higher pressure, portion of the exhaust hood to the lower pressure zone below it to decrease the build-up of pressure in the top portion of the exhaust hood and thus to increase the energy available to the turbine to do work and to decrease energy loss caused by friction and thus to increase turbine efficiency.

* * * * *